United States Patent [19]

Kyte et al.

[11] 4,062,991

[45] Dec. 13, 1977

[54] TREATMENT OF WOOD

[75] Inventors: Colin Trevor Kyte, Marlow; Geoffrey John Lewis, Hazelmere; Edgar Pearce, High Wycombe; Keith Hume, Camberley, all of England

[73] Assignee: Fosroc A.G., Zug, Switzerland

[21] Appl. No.: 497,161

[22] Filed: Aug. 13, 1974

[30] Foreign Application Priority Data

| | | |
|---|---|---|
| Aug. 15, 1973 | United Kingdom | 38648/73 |
| Mar. 1, 1974 | United Kingdom | 9474/74 |
| June 11, 1974 | United Kingdom | 25911/74 |

[51] Int. Cl.[2] ..... B27K 3/10

[52] U.S. Cl. ..... 427/297; 21/7; 21/65; 118/50; 427/298; 427/393; 427/440; 427/441

[58] Field of Search ..... 117/147, 102, 148, 116, 117/57, 59; 21/7, 65; 118/50; 427/297, 298, 393, 440, 441; 106/15 R, 15 AF, 15 FP

[56] References Cited

U.S. PATENT DOCUMENTS

| | | | |
|---|---|---|---|
| 1,197,997 | 9/1916 | Barry | 117/59 |
| 1,499,791 | 7/1924 | Shipley | 117/116 |
| 1,756,797 | 4/1930 | Rawson | 117/116 |
| 2,045,350 | 6/1936 | Griffin | 117/148 |
| 2,054,399 | 9/1936 | White | 117/116 |
| 2,350,845 | 6/1944 | Vaughn | 117/59 |
| 2,629,674 | 2/1953 | Ericks | 117/147 |
| 2,629,701 | 2/1953 | Ericks | 117/147 |
| 2,655,454 | 10/1953 | Farber | 117/116 |
| 2,786,784 | 3/1957 | Henrikkson | 427/440 |
| 2,931,737 | 4/1960 | Thornton | 117/116 |
| 3,200,003 | 8/1965 | Bescher | 21/65 |
| 3,233,579 | 2/1966 | Arvidson | 118/50 |
| 3,467,546 | 9/1969 | Page et al. | 117/116 |
| 3,547,849 | 12/1970 | Kennedy | 260/22 |
| 3,859,046 | 1/1975 | Hurst et al. | 21/7 X |
| 3,889,020 | 6/1975 | Amundsen et al. | 427/298 X |

*Primary Examiner*—Michael R. Lusignan

*Attorney, Agent, or Firm*—Caesar, Rivise, Bernstein & Cohen

[57] ABSTRACT

An agent for stabilization of a decorative finish is incorporated in a timber preservative composition comprising a preservative e.g., fungicide, insecticide or fire retardant in an organic solvent e.g. white spirit, chlorinated hydrocarbon such as methylene chloride or a liquified butane or propane for use in a double vacuum treatment of the timber. The agent may be an alkyd resin or colloidal pigment of a defined mean particle size, or both.

8 Claims, No Drawings

TREATMENT OF WOOD

The invention relates to the preservation of timber (including timber composites) and in particular concerns methods of preserving and decorating timber preferably but not exclusively by means of a so-called double vacuum system of the type described and claimed in copending application Ser. No. 282,513, filed Aug. 21, 1972, now U.S. Pat. No. 3,859,046 (cases P. 20) in which an organic solvent preservative composition is used.

It is known to subject preserved timber to a further treatment in order to enhance its resistance to moisture and also its decorative appearance. One method of doing this is by applying a paint film and another is by applying a so-called stain to the timber which will enhance its natural grain effect. Whichever system is adopted there are difficulties in applying it on a commercial scale in relation to timber which has been treated by a double vacuum process using an organic solvent preservative composition. Thus, in the case of the subsequent painting there is a tendency for relatively poor adhesion between the paint and the treated wood and also a deterioration of the glass of a finishing paint coat. Further, it is necessary for a delay to occur before the subsequent painting may be done. In the case of the staining, this can be done to a stack of timber within the treatment vessel of a double vacuum process but there is a tendency for an uneven finish to be obtained as between timber making up one part of the stack and another. As a result, because of this colour difference, not all of the timber making up the stack is commercially acceptable which results in wastage.

It is an object of this invention to provide a method of treating timber by a double vacuum process in which the timber to be treated is prepared to receive without unacceptable delay, a firmly adherent high gloss paint finish or which has an even stain. In this way, by a double vacuum process, it is possible to obtain a relatively high quality commercially attractive and preserved product.

According to the invention there is provided a method of treating timber comprising:

contacting the timber while under an initial vacuum with an organic preservative composition, which composition comprises a preservative in an organic solvent and also contains an agent which will penetrate into the timber to facilitate the stabilisation of a decorative finish, optionally applying a positive pressure, removing the preservative composition from the timber, applying a second vacuum to remove excess preservative composition, and releasing the second vacuum.

In the case of a paint decorative finish to be applied subsequently, the agent in question preferably comprises an air oxidising resin or oil (which customarily will also be present in the paint). Because the same ingredient is present both in the preserved timber and in the subsequently applied paint there is a tendency for an improved bonding of the paint to the timber. Typically, the air oxidising agent will tend to be an alkyd resin which, in order that it will air oxidise will tend to be of the long oil type, i.e. it will have a relatively high content (say of the order of 50%) of oil in the solid resin. A alkyd resin may be prepared by modifying a polyhydric alcohol with an oil and reacting the modified alcohol with an agent such as phthalic anhydride or the like. An example of a polyhydric alcohol is glycerol or pentaerithyritol and suitable modifying oils include linseed, tung, fish, soya and dehydrated caster oils.

The content of the air oxidising resin or oil or other agent in the preservative composition is preferably in the range of from about 3% to about 25% by weight, conveniently 10% to about 20% by weight. If the concentration exceeds the upper limit there is a tendency for the viscosity of the preservative composition to become unacceptable.

In the case of a stain, the agent in question is preferably a colloidal pigment having a mean particle diameter size in the range of 0.02 micron to about 1 micron. By the use of this type of agent a grain staining decorative finish is stabilised. If the particle size is below the defined limit not only does the pigment tend to penetrate the timber but when the excess solvent is extracted and evaporated off at the second vacuum stage the pigment is brought back to the timber surface; conversely if the pigment particle size is too coarse it will not permeate evenly between closely piled timber when stacked inside the timber plant of the double vacuum process. Both agents may be present in the one preservative composition.

The preservative may be a fungicide and/or insecticide and/or fire retardant. The solvent may be an organic solvent of the type customarily used in timber preservation and is preferably a petroleum hydrocarbon of the white spirit type or a chlorinated hydrocarbon recoverable solvent such as methylene chloride or a liquified butane or propane.

The double vacuum pressure impregnation may be carried out by the techniques described and claimed in our copending application above mentioned.

The invention includes timber when preserved by the method and also, as new compositions of matter, the preservative compositions above defined.

In order that the invention may be well understood, Examples will now be given by way of illustration only.

EXAMPLE I

A preservative composition of the invention was formulated by adding ingredients specified below in the order indicated to the white spirit solvent.

| Ingredient | parts by weight |
|---|---|
| fungicide | 1.5 |
| insecticide | 0.5 |
| long oil alkyd resin | 15.0 |
| methyl ethyl ketoxime | 1.0 |
| water repellent | 0.7 |
| white spirit | 81.3 |
| | 100.0 |

A load of redwood timber (*Pinus sylvestris*) was treated with the preservative composition according to the technique of our copending Application Ser. No. 282,513 under the following conditions:

drawing of a initial vacuum of about -380 mm Hg for 3 minutes flooding with preservative composition application of a positive pressure of about 760 mm Hg for about 3 minutes removal of the preservative composition application of a final vacuum of about -630 mm Hg for at least 20 minutes.

The timber was removed from the treatment vessel and subjected to the evaluations below.

In a first comparative evaluation, different panels of *Pinus sylvestris* containing bath heartwood and sapwood and each measuring 300 mm × 100 mm × 15 mm were treated as described above, with a preservative composition which was free of the long oil alkyd resin, and left untreated (control). Each panel was dipped in an alkyd-based primer paint, the treated panels being dipped 60 minutes after treatment with the respective preservative composition. All three sets of specimens were exposed to the weather in a horizontal position for nine weeks. The strength of the adhesion between the primer paint film and the timber was then measured using a hand tensiometer. The results obtained expressed as percentage difference relative to the control panels were as follows:

| | |
|---|---|
| controls (untreated) | 100 |
| panels treated with preservative composition having no alkyd resin | 54 |
| panels treated with preservative composition of the invention | 104 |

These results show that the inclusion of the alkyd resin in the preservative composition improves the adhesion of the primer paint film to the preserved wood.

In a second comparative evaluation three sets of panels as in the first evaluation were primed with a fast drying alkyd primer of the type used in the timber industry within 30 minutes following treatment with the preservative composition (except for the control). Undercoat and gloss paint coatings were then applied to the panels at 24 hour intervals. After drying it was observed that the gloss finish of the panels treated with the preservative composition of the invention was similar to that of the control panels, whereas that using the alkyd resin-free preservative composition was inferior. The following gloss reflectance meter readings were noted:

| | |
|---|---|
| untreated control panels | 71% |
| panels treated with preservative composition having no alkyd resin | 59% |
| panels treated with the preservative composition of the invention | 83% |

The results show that it is possible to apply a primer and paint coating to wood treated with preservative composition according to the invention within a relatively short period following treatment with the preservative composition without deteriorating the gloss of the finish paint coating. This is not the case where the wood has been treated by means of a preservative composition which lacks the alkyd resin ingredient.

EXAMPLE II

A preservative composition was made by adding the ingredients specified below in the order indicated to the white spirit solvent.

| Ingredient | parts by weight |
|---|---|
| fungicide | 1.5 |
| insecticide | 0.5 |
| long oil alkyd resin | 15.0 |
| methyl ethyl ketoxime | 1.0 |
| water repellent | 0.7 |

-continued

| Ingredient | parts by weight |
|---|---|
| transparent colloidal ferric hydroxide pigment dispersed in toluene 40% | 10.0 |
| solvent | 71.3 |
| | 100.0 |

The preservative composition was used to treat spruce (*Picea abies*) and (*Picea sitchensis*) by a double vacuum impregnation technique according to copending Application Ser. No. 282,513 and under the following conditions:

drawing of a initial vacuum of about -630 mm Hg for 1 hour
flooding with preservative composition
application of a positive pressure of about 380 mm Hg for about 1 hour
removal of the preservative composition
application of a final vacuum of about -600 mm Hg for at least 20 minutes.

In this case, the load of timber treated comprises boards which were stacked one on top of another within the treatment vessel. Despite this, on examination of the load following treatment the pieces of timber were found to have an enhanced grain pattern which was uniform irrespective of whether the piece was at the top, bottom or at the side of the stack.

In the Examples reference has been made to a fungicide and insecticide and examples of such agents include tributyl tin oxide, gamma benzene hexachloride and penta chloro phenol.

EXAMPLE III

A preservative composition was made up by adding the following ingredients to white spirit.

| Ingredient | parts by weight |
|---|---|
| fungicide | 1.5 |
| insecticide | 0.5 |
| hydrocarbon co-solvent for fungicide | 10 |
| water repellent | 0.7 |
| transparent colloidal ferric hydroxide, 40% dispersed in toluene | 10 |
| white spirit | 77.3 |
| | 100.0 |

The composition prepared in this way was used to treat timber by a double vacuum process according to the techniques above described. The timber was stacked in a close density and following treatment was inspected when it was observed that the individual pieces of timber were stained to a uniform density irrespective of their position within the stack contained in the treatment vessel and to a depth of about 3 mm from any lateral surface, both in heartwood and sapwood.

These Examples illustrate the value of adding to an organic preservative composition in a double vacuum process an agent which will stabilize a decorative finish, which agent can be an alkyd resin or a colloid pigment of defined mean particle size or both of these agents together.

We claim:

1. A method of treating timber comprising subjecting the timber to a first vacuum step, applying an organic preservative composition to the timber while under vacuum, said composition comprising a preservative in an organic solvent, said first vacuum being applied in a sufficient amount and for a sufficient time to permit the organic preservative composition to penetrate the timber, removing the preservative composition from the timber, subjecting the timber to a second vacuum step to remove excess preservative composition, drying said timber and applying stain thereto, said organic preservative composition including an air oxidizing agent selected from the group consisting of air oxidizing resin and oil, said agent serving to reduce drying time substantially.

2. The method of claim 1 including the step of applying a positive pressure after said first vacuum step.

3. The method of claim 1 in which the air oxidizing agent is a long oil alkyd resin.

4. The method of claim 1 in which the content of the air oxidizing agent in the preservative composition is from about 3% to about 25% by weight.

5. The method of claim 4 in which the content of the air oxidizing agent is about 10% to about 20% by weight.

6. The method of claim 1 in which the preservative is selected from the group consisting of fungicides, insecticides and fire retardants.

7. The method of claim 1 in which the organic solvent is selected from a group consisting of petroleum hydrocarbons, chloronated hydrocarbons, liquified butanes and propanes.

8. A method of treating timber comprising subjecting the timber to a vacuum, applying a liquid composition to the timber, applying a positive pressure to the liquid composition, said vacuum and said pressure being applied in a sufficient amount and for a sufficient time to permit the liquid composition to penetrate the timber on all surfaces thereof, said liquid composition comprising an organic preservative composition in an organic solvent and a transparent ferric hydroxide colloidal pigment, said colloidal pigment having a mean particle diameter size in the range of about 0.02 micron to about 1 micron, said colloidal pigment being present in an amount sufficient to enhance the grain pattern of the timber, removing the liquid composition and applying a second vacuum to the timber to remove excess liquid composition.

* * * * *